US007509695B2

(12) United States Patent
Zheng

(10) Patent No.: US 7,509,695 B2
(45) Date of Patent: Mar. 31, 2009

(54) PORTABLE SUPPORT ASSEMBLIES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 12/012,881

(22) Filed: Feb. 6, 2008

(65) Prior Publication Data

US 2008/0214332 A1 Sep. 4, 2008

Related U.S. Application Data

(63) Continuation-in-part of application No. 11/704,473, filed on Feb. 9, 2007, now abandoned.

(51) Int. Cl.
*A47C 19/14* (2006.01)
*A47C 17/64* (2006.01)
*A63B 63/00* (2006.01)

(52) U.S. Cl. ..... 5/116; 5/112; 5/413 R; 5/923; 297/229; 446/901; 273/317; 273/317.3; 273/348; 273/371; 273/407; 273/108; 473/476; 473/479; 473/469

(58) Field of Classification Search ..... 5/110–116, 5/496, 498, 923, 413 R, 413 AM; 297/229; 38/140; 446/901; 273/317, 317.3, 348, 371, 273/407, 108; 473/476, 479, 465
See application file for complete search history.

(56) References Cited

U.S. PATENT DOCUMENTS

| | | | | | |
|---|---|---|---|---|---|
| 37,153 | A * | 12/1862 | Cross | 5/115 |
| 327,055 | A * | 9/1885 | Baker | 5/115 |
| 3,243,827 | A * | 4/1966 | Kintner | 5/496 |
| 4,788,727 | A | 12/1988 | Liu | |
| 4,984,768 | A * | 1/1991 | Kolber et al. | 297/16.1 |
| 5,172,435 | A * | 12/1992 | Griffin et al. | 5/95 |
| 6,134,727 | A * | 10/2000 | Hwang | 5/114 |
| 6,557,192 | B2 | 5/2003 | Zheng | |
| 6,763,534 | B2 * | 7/2004 | Hwang | 5/114 |
| 7,032,262 | B2 * | 4/2006 | Creech | 5/497 |
| 7,231,677 | B1 * | 6/2007 | Reeves | 5/419 |
| 2002/0095723 | A1 * | 7/2002 | Nation | 5/110 |
| 2004/0019968 | A1 * | 2/2004 | Vlassis et al. | 5/413 R |
| 2006/0075554 | A1 * | 4/2006 | Zheng | 5/413 R |
| 2008/0052822 | A1 * | 3/2008 | Hibma | 5/114 |

* cited by examiner

*Primary Examiner*—Alexander Grosz
(74) *Attorney, Agent, or Firm*—Raymond Sun

(57) ABSTRACT

An apparatus has a collapsible base that assumes a deployed position and a collapsed position where the base has a smaller size than in the deployed configuration. A surface is removably attached to the base. The base includes a frame system that includes a plurality of struts that are hingedly connected to each other. The surface can be used as a sleeping surface, a table top, a game surface, or for other similar purposes.

6 Claims, 5 Drawing Sheets

PORTABLE SUPPORT ASSEMBLIES

RELATED CASES

This is a continuation-in-part of Ser. No. 11/704,473, filed Feb. 9, 2007 now abandoned.

BACKGROUND OF THE INVENTION

1. Field of the Invention

The present invention relates to a portable assemblies, and in particlar, to support assemblies such as bed assemblies and other game assemblies, which can be disassembled for convenient storage and transportation.

2. Description of the Prior Art

Conventional beds are rather bulky and heavy, and are therefore difficult to move around. However, in today's society, people are constantly moving around, and the need for portable bedding is greater than ever.

One conventional type of portable bedding is the sleeping bag. Sleeping bags can be rolled or folded up, thereby making them easy to pack, store and carry around. Sleeping bags are also very easy to set up for use. Unfortunately, sleeping bags are not very comfortable because the user is essentially sleeping directly on the ground, and most conventional sleeping bags do not provide enough padding so that the user will inevitably feel the ground as he/she is sleeping in the sleeping bag. Conventional mats are similar to sleeping bags and suffer from similar drawbacks.

Another conventional type of portable bedding is an inflatable mattress. Inflatable mattresses come close to providing the comfort and environment of a traditional bed as they elevate the user from the ground while providing a comfortable yet sufficiently firm sleeping surface. However, inflatable mattresses are not as convenient to use. They must be inflated for use, and then deflated for storage. Unless the user has access to a pump, the inflation and deflation of an inflatable mattress can be very time-consuming.

Beds are one type of support assembly in that they support a human being who lies flat on the surface of the support assembly. Other support assemblies can include tables and game surfaces, among others, and these support assemblies all share similar concerns with respect to ease of use, storage and transportation.

Thus, there still remains a need for portable bedding that is comfortable for the user, yet is easy to install and disassemble for storage. There also remains a need for portable assemblies that easy to install and disassemble for storage.

SUMMARY OF THE DISCLOSURE

The present invention provides an apparatus that has a collapsible base that assumes a deployed position and a collapsed position where the base has a smaller size than in the deployed configuration. A surface is removably attached to the base. The base includes a frame system that includes a plurality of struts that are hingedly connected to each other. The surface can be used as a sleeping surface, a table top, a game surface, or for other other similar purposes.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
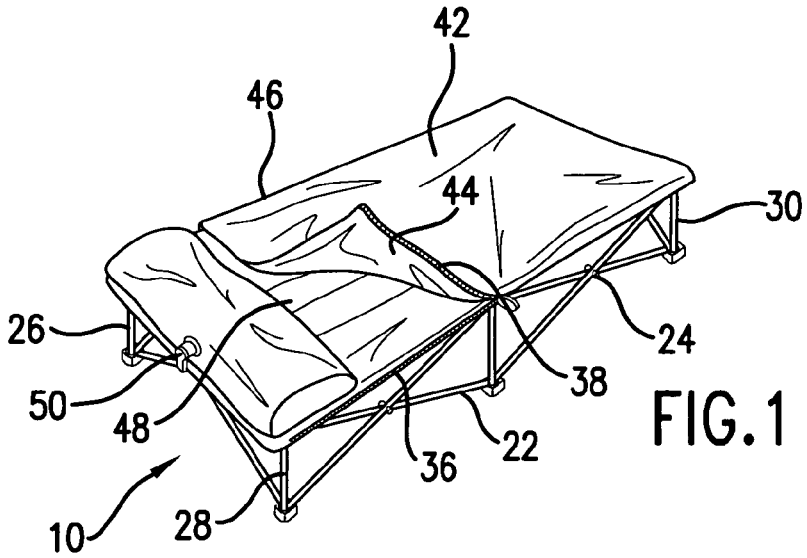
FIG. 1 is a perspective view of a portable sleeping assembly according to one embodiment of the present invention.
Figure 2:
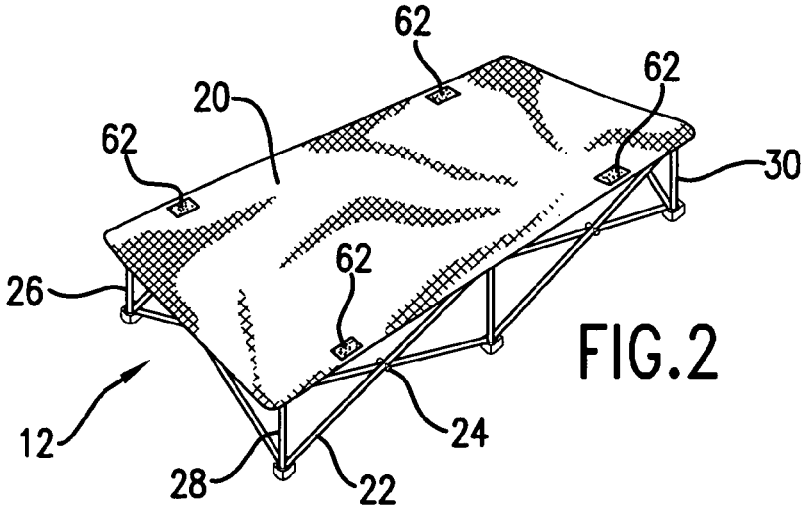
FIG. 2 is a perspective view of the collapsible base of the assembly of FIG. 1.
Figure 3:
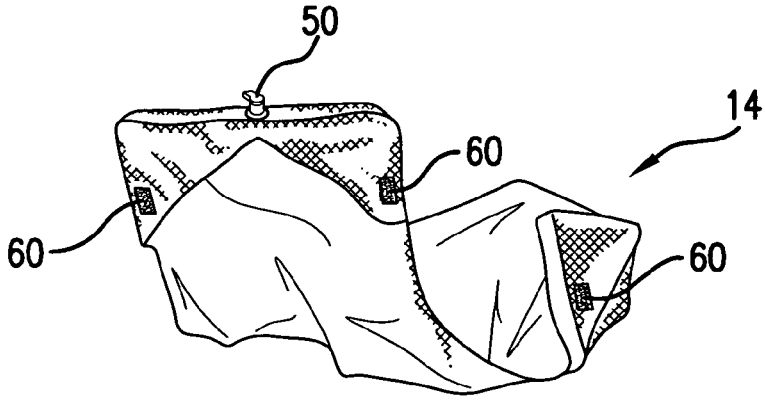
FIG. 3 is perspective view of the sleeping bag of the assembly of FIG. 1.

Referring to FIGS. 1-3, the present invention provides a portable sleeping assembly 10 which includes a collapsible base 12 and a sleeping bag 14 that can be removably attached to the base 12. The assembly 10 can be used by a human being or a pet animal.

Figure 4:
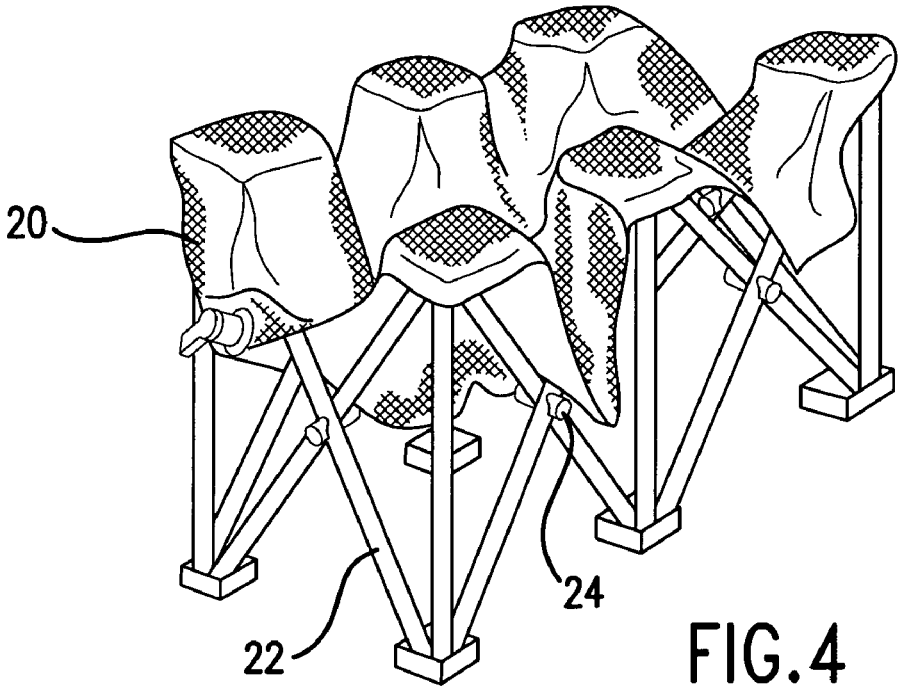
FIGS. 4-5 illustrate how the collapsible base of FIG. 2 can be collapsed for storage.
Figure 5:
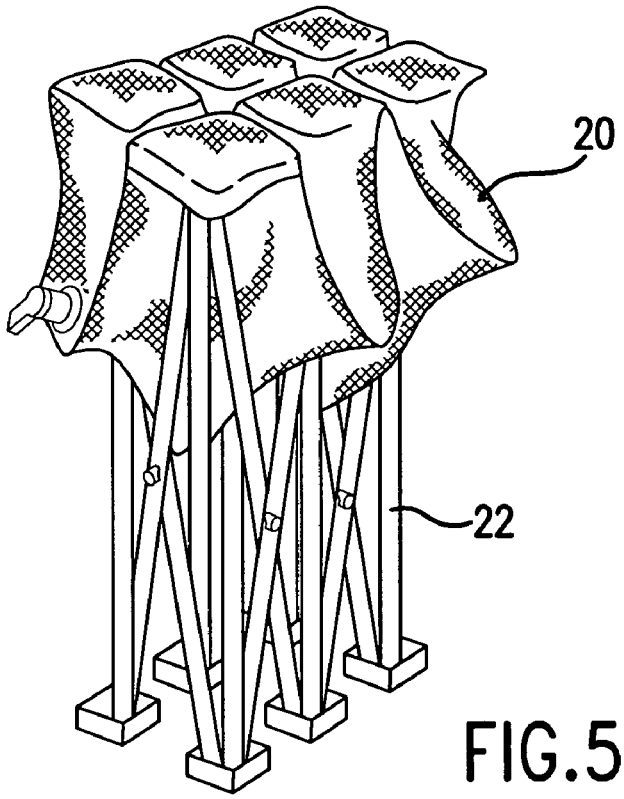

The collapsible base 12 has a top panel 20 that can be made of a fabric. A collapsible frame system is provided below the top panel 20 to support the top panel 20 above the ground. The frame system also functions to allow the entire base 12 to be collapsed into a smaller size and shape for storage. The frame system can be any known collapsible frame system, but in the present embodiment, can include a plurality of struts 22 that are connected to each other at hinges 24. The struts 22 are adapted to be folded or pivoted at the locations of the hinges 24. Four vertical struts 26, 28, 30 at the four side corners of the base 12 function as legs for supporting the top panel 20 at a raised or suspended position with respect to the ground. The top panel 20 can be secured to the top of the frame system. As shown in FIGS. 4 and 5, the frame system can be folded and collapsed by pivoting the struts 22 about the hinges 24 to fold the frame system into a small and compact arrangement. Since the top panel 20 is made of a fabric, it can be folded and tucked into the spaces between the respective struts 22.

The sleeping bag 14 can be any conventional sleeping bag or mat piece, but according to one embodiment of the present invention, the sleeping bag 14 can be embodied in the form of the sleeping bag described in connection with FIG. 1 of U.S. Pat. No. 6,557,192, whose entire disclosure is incorporated by this reference as though set forth fully herein. In particular, the sleeping bag has a generally rectangular outer layer 42 that is made of a suitable water-resistant sheet material, and a co-extensive inner rectangular layer or liner 44 that is preferably of a nappy material such as flannel. The outer and inner layers 42, 44 are connected together around their perimeters by a stitching to form a two-layer bag panel. The air space between the layers 42, 44 provides a certain amount of insulation. Zipper slides 36, 38 can be secured by a stitching to the opposite side edges of the bag panel, and to the bottom of the bag panel on opposite sides of a vertical centerline 46, so that when the bag panel is folded along the centerline, the zipper slides 36, 38 may be joined together by a zipper slider to form the sleeping bag shown in FIG. 1. Access to the interior of the sleeping bag 14 can be through the open head 48 of the bag 14. The bottom of the sleeping bag 14 can be provided with removable attachment mechanisms (e.g., VELCRO™ pads 60) that can be removably attached to removable attachment mechanisms (e.g., VELCRO™ pads 62) provided on the top surface of the top panel 20.

As an alternative, the sleeping bag 14 can be an inflatable sleeping bag which can be inflated via inflation ports 50.

In use, the sleeping bag 14 can be folded together, or rolled up, to reduce its size and shape. The base 12 can be folded and collapsed by pivoting the struts 22 about the hinges 24 to fold the frame system into a small and compact arrangement, as shown in FIGS. 4-5. The collapsed bag 14 and base 12 are lightweight, and can be conveniently stored in a small storage space. The portable sleeping assembly 10 can be deployed by extending and unfolding the base 12 until it assumes the configuration shown in FIG. 2. Next, the sleeping bag 14 can be unfolded, and then secured to the top panel 20, and the portable sleeping assembly 10 would be ready for use. The sleeping bag 14 is raised from the ground by the base 12, thereby providing the user with a more comfortable sleeping surface. In addition, by providing the sleeping bag 14 to be removable from the base 12, the sleeping bag 14 can be washed, or even replaced with another sleeping bag 14.

Figure 9:
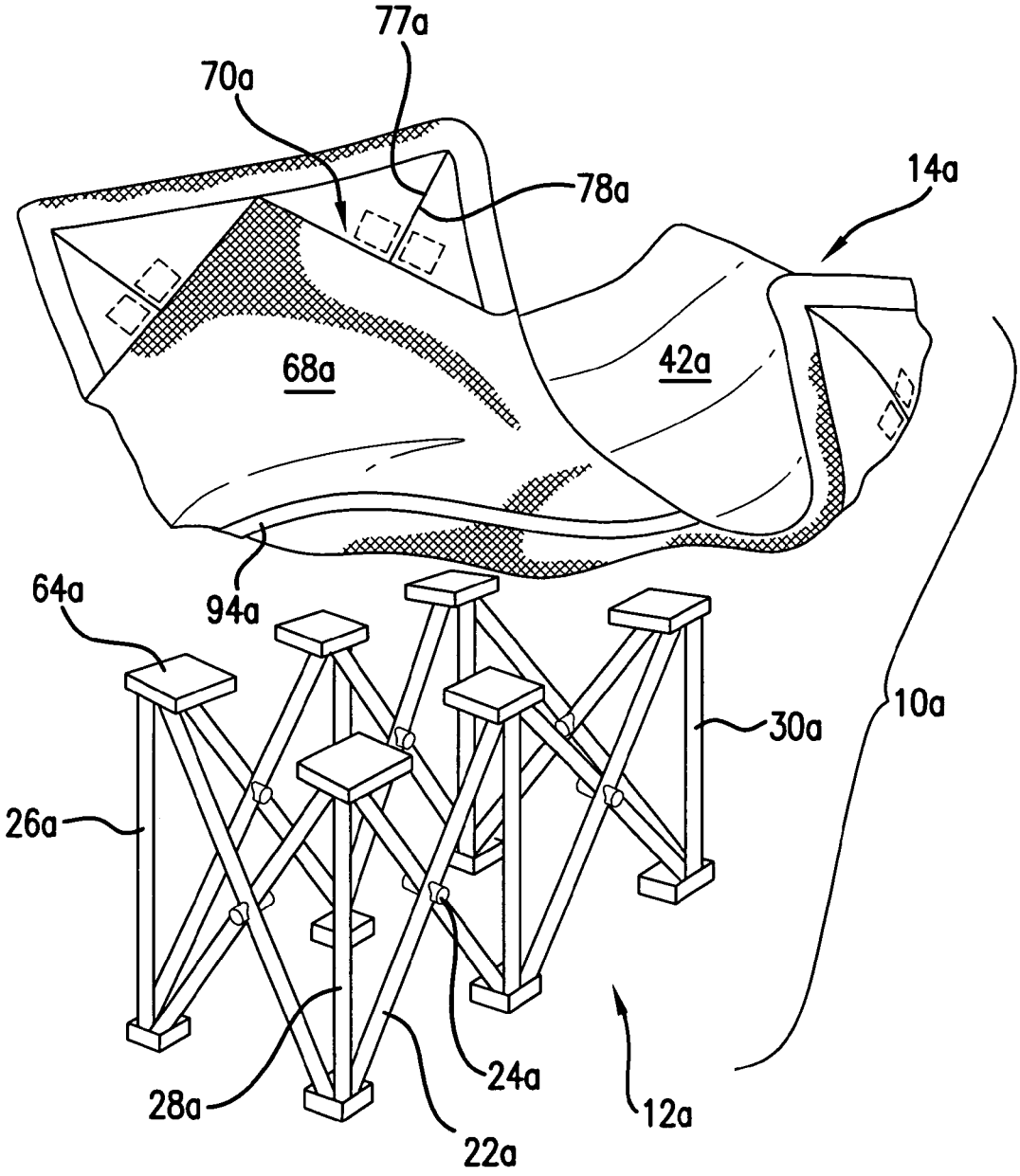
FIG. 9 is an exploded perspective view of a portable assembly according to another embodiment of the present invention showing a modification to the embodiment of FIGS. 1-5.
Figure 10:
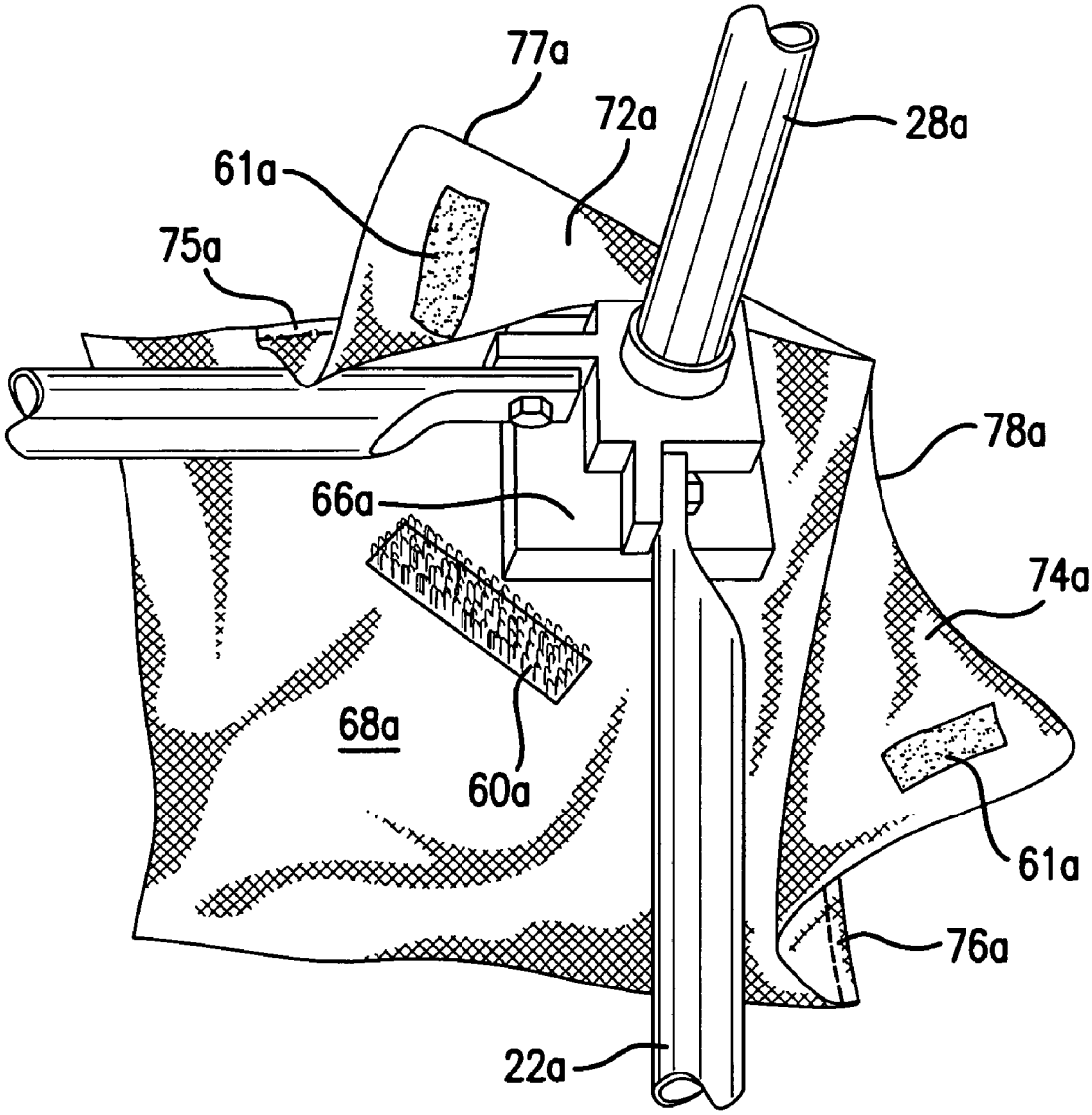
FIG. 10 is an enlarged view of a portion of the assembly of FIG. 9.

FIGS. 9-10 illustrate a modification that can be made to the embodiment of FIGS. 1-5. Specifically, the base panel 20 can be omitted in FIGS. 9-10. Referring to FIGS. 9-10, the portable sleeping assembly 10*a* includes a collapsible base 12*a* and a sleeping bag 14*a* that can be removably attached to the base 12*a*.

The collapsible base 12*a* does not have the top panel 20 from FIGS. 1-5, but still has a collapsible frame system that is provided to support the sleeping bag 14*a* above the ground. The frame system can be the same as the frame system of FIGS. 1-5, and can include a plurality of struts 22*a* that are pivotably connected to each other at hinges 24*a*. The struts 22*a* are adapted to be folded or pivoted at the locations of the hinges 24*a*. Four vertical struts (e.g., 26*a*, 28*a*, 30*a*) can be provided at the four side corners of the base 12*a* to function as legs for supporting the sleeping bag 14*a* at a raised or suspended position with respect to the ground. Hub pieces 64*a* can be provided to pivotably connect ends of three or more struts 22*a*, 26*a*, 28*a*, 30*a* in a manner where the hub pieces 64*a* also act as hinges. Each hub piece 64*a* has an enlarged top plate 66*a*. The frame system can be folded and collapsed by pivoting the struts 22*a* about the hinges 24*a* to fold the frame system into a small and compact arrangement.

The sleeping bag 14*a* can be the same as the sleeping bag 14 in FIGS. 1-5, and can include a generally rectangular outer layer 42*a* that is made of a suitable water-resistant sheet material, and a co-extensive inner rectangular layer or liner (not shown, but can be the same as 44) that is preferably of a nappy material such as flannel. The outer layer 42*a* and the inner layer can be connected together around their perimeters by a stitching to form a two-layer bag panel. The air space between the layers 42*a* provides a certain amount of insulation. Zipper slides (not shown, but can be the same as 36, 38) can be secured by a stitching to the opposite side edges of the bag panel, and to the bottom of the bag panel on opposite sides of a vertical centerline, in the same manner as for the sleeping bag 14 in FIGS. 1-5.

The bottom 68*a* of the sleeping bag 14*a* (which is part of the layer 42*a*) can be provided with a plurality of pockets 70*a*, an example of which is shown in greater detail in FIG. 10. Each pocket 70*a* is adapted to receive one plate 66*a* of the frame system, so the pockets 70*a* can be provided at any location along the bottom 68*a* where the sleeping bag 14*a* might be expected to be coupled to a plate 66*a*. In one embodiment, the pockets 70*a* can be provided at the four corners of the bottom 68*a* of the sleeping bag 14*a*, and at the center of the bottom 68*a* along the side edges. Each pocket 70*a* has two flaps 72*a*, 74*a* that can be sewn to the edges of the bottom 68*a*. Each flap 72*a*, 74*a* can have a generally triangular shape, with one edge (e.g., 75*a*, 76*a*) sewn to a different edge of the bottom 68*a*, and with the other two edges being free. The sewn edges 75*a* and 76*a* of the flaps 72*a* and 74*a*, respectively, can be oriented by about ninety degrees from each other so that two adjacent free edges 77*a* and 78*a* of the flaps 72*a* and 74*a*, respectively, are positioned next to each other as shown in FIG. 9. A VELCRO™ pad 60*a* can be provided at the bottom 68*a* adjacent each pocket 70*a*, and each flap 72*a*, 74*a* can have a VELCRO™ pad 61*a* provided on its inner surface so that the pads 61*a* can be attached to the pad 60*a* to close the interior space of the pocket 70*a* after a plate 66*a* has been inserted into the pocket 70*a*. This interior space would be defined by the flaps 72*a*, 74*a* and the bottom 68*a*. By securing the plates 66*a* of the hubs 64*a* in corresponding pockets 70*a*, the sleeping bag 14*a* can be secured on top of the frame system. In addition, the sleeping bag 14*a* can be provided with a support belt or strap 94*a* that extends across the width of the sleeping bag 14*a*. The belt 94*a* provides a support for holding the sleeping surface of the sleeping bag 14*a* flat and raised against the weight of the person.

Figure 6:
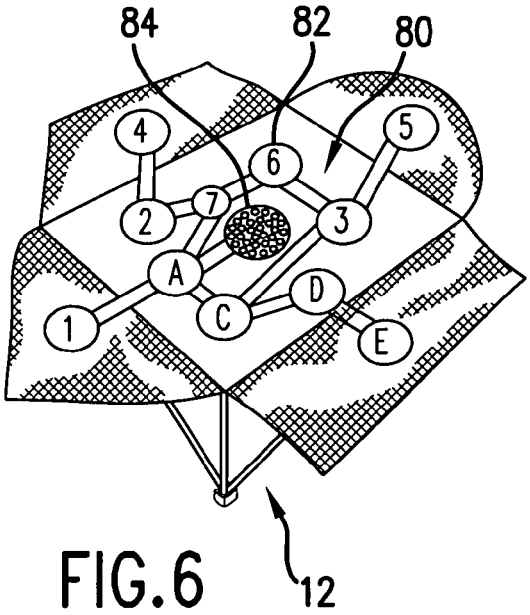
FIGS. 6-8 illustrate portable assemblies according to other embodiments of the present invention.
Figure 7:
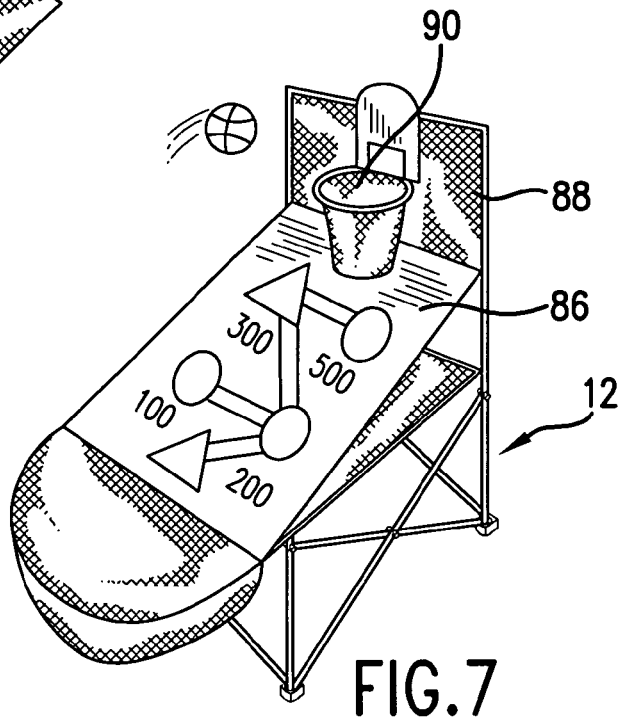
Figure 8:
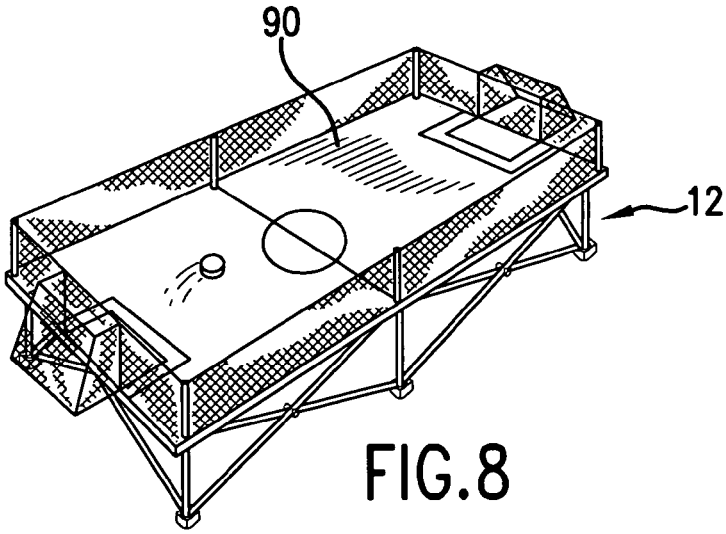

The principles of the present invention can be extended to non-sleep applications. FIG. 6-8 illustrate the foldable base 12 of FIGS. 1-5 being used to support game surfaces. FIG. 6 illustrates the base 12 being used to support a generally flat or planar game surface 80 that can be made of fabric or foldable cardboard, and having electronic touch pads 82 and a speaker 84 provided thereon. FIG. 7 illustrates the base 12 being used to support a generally flat or planar game surface 86 that has been angled with respect to the top panel 20 of the base 12, and having a detachable backboard 88 that supports a net 90. FIG. 8 illustrates the base 12 being used to support a generally flat or planar ping pong or table soccer surface 90 that can be made of cardboard or a hard material. All the surfaces 80, 86 and 90 can be made of any appropriate material that facilitates the desired activity while being convenient to fold or reduce in size. The surface 80, 86, 90 can be removably attached to the base panel 20 in the same manner as described above in connection with FIGS. 1-3, or removably attached to the frame system in the same manner as described above in connection with FIGS. 9-10.

Even though the present invention has been described in connection with a sleeping bag 14, 14*a*, the sleeping bag is essentially providing a support surface for sleeping. The principles of the present invention and the embodiments of FIGS. 1-5 and 9-10 can be extended to a game surface (as described above in connection with FIGS. 6-8), or for use as a table. Therefore, the elements 14 and 14*a* can be used to represent a mattress, a mat, a fabric sleep surface (without covers), a table top, and a flat or other surface or panel for other use.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A sleeping apparatus, comprising:

a collapsible base that assumes a deployed position and a collapsed position where the base has a smaller size than in the deployed configuration, the base having a plurality of struts pivotably connected by a plurality of hinges, the base also having a plurality of hubs, with the struts folded about the hinges and hubs when the base is converted from the deployed position to the collapsed position; and a sleeping mat having a plurality of connectors, with each connector removably connected to a separate hub, wherein each connector comprises a pocket that receives a portion of a separate hub, each pocket being defined by two flaps and an interior surface of the mat, with an interior space defined by the flaps and an interior surface of the mat, each pocket further including attachment mechanisms that removably attach each flap to an interior surface of the mat.

2. The apparatus of claim 1, wherein the hub has an enlarged plate that is received inside the interior space of the pocket.

3. The apparatus of claim 1, wherein the sleeping bag comprises:

an outer layer having an outer surface;

an inner liner superimposed and coextensive with the outer layer, the inner liner having an outer surface; and wherein the inner liner and outer layer are secured together.

4. A game apparatus, comprising:

a collapsible base that assumes a deployed position and a collapsed position where the base has a smaller size than in the deployed configuration, the base having a plurality of struts pivotably connected by a plurality of hinges, the base also having a plurality of hubs, with the struts folded about the hinges and hubs when the base is converted from the deployed position to the collapsed position; and a game surface having a plurality of connectors, with each connector removably connected to a separate hub, wherein each connector comprises a pocket that receives a portion of a separate hub, each pocket being defined by two flaps and a bottom portion of the game surface, with an interior space defined by the flaps and the bottom portion of the game surface, each pocket further including attachment mechanisms that removably attach each flap to the bottom portion of the game surface.

5. The apparatus of claim 4, wherein the hub has an enlarged plate that is received inside the interior space of the pocket.

6. The apparatus of claim 4, wherein the game surface includes electronic pads provided thereon.

* * * * *